United States Patent [19]

McAbee et al.

[11] Patent Number: 5,074,262

[45] Date of Patent: Dec. 24, 1991

[54] SPARK DEVICE FOR INTERNAL COMBUSTION ENGINES

[76] Inventors: Mac McAbee, 4014 Lincoln Pl. Dr., Des Moines, Iowa 50312; Scott Campbell, 2518 N.E. 102nd Ave., Ankeny, Iowa 50021

[21] Appl. No.: 598,834

[22] Filed: Oct. 15, 1990

[51] Int. Cl.[5] ..... F02P 15/08

[52] U.S. Cl. ..... 123/169 MG; 313/123

[58] Field of Search ..... 123/310, 143 B, 169 MG; 313/123

[56] References Cited

U.S. PATENT DOCUMENTS

| | | | |
|---|---|---|---|
| 1,191,429 | 7/1916 | Jensen | 123/169 MG |
| 1,247,049 | 11/1917 | Willett | 123/169 MG |
| 1,353,593 | 9/1920 | Jorgenson | 123/169 MG |
| 1,476,252 | 12/1923 | Hempel | 123/169 MG |
| 2,904,610 | 9/1959 | Morrison | 123/169 MG |
| 4,535,735 | 8/1985 | Yoshinaga et al. | 123/169 MG |

FOREIGN PATENT DOCUMENTS

| | | | |
|---|---|---|---|
| 3022520 | 12/1981 | Fed. Rep. of Germany | 123/169 MG |

*Primary Examiner*—Willis R. Wolfe

*Attorney, Agent, or Firm*—Zarley, McKee, Thomte, Voorhees & Sease

[57] ABSTRACT

The spark device of the present invention includes a line of spaced apart conductor segments which have small spark gaps therebetween. One end of the line of segments is connected to a source of electrical energy, and the other end is connected to ground. Upon applying electrical energy to the line of segments, a plurality of sparks are emitted simultaneously at each of the spark gaps. The device can be in the form of a conventional spark plug or can be embedded in a circular body mounted to the combustion engine as part of the gasket assembly.

13 Claims, 2 Drawing Sheets

SPARK DEVICE FOR INTERNAL COMBUSTION ENGINES

BACKGROUND OF THE INVENTION

The present invention relates to a spark device for internal combustion engines.

Many internal combustion engines currently utilize a spark plug for initiating a spark in the combustion chamber of the internal combustion engine. One disadvantage of the spark plug is that it delivers a single spark centrally located at the upper end of the combustion chamber. Consequently, the fuel within the combustion chamber is ignited more slowly than would be the case if a plurality of sparks could be delivered to different locations within the combustion chamber. By utilizing a plurality of sparks, it would be possible to ignite the fuel within the combustion chamber more quickly and more thoroughly so as to improve the efficiency and power of the engine.

Therefore, a primary object of the present invention is the provision of an improved spark device for internal combustion engines.

A further object of the present invention is the provision of an improved spark device for internal combustion engines which delivers a plurality of sparks to the combustion chamber of the engine.

A further object of the present invention is the provision of an improved spark device for internal combustion engines, wherein a plurality of sparks are delivered simultaneously within the combustion chamber so as to more fully ignite and burn the fuel in the combustion chamber.

A further object of the present invention is the provision of an improved device which will provide sparks to the combustion chamber, but which does not foul or become carbon coated as easily as prior spark plugs.

A further object of the present invention is the provision of an improved spark device which can deliver a plurality of sparks in a predetermined pattern which is correctly positioned so as to maximize the combustion.

A further object of the present invention is the provision of an improved spark device which can be customized to create different patterns as required for different designs.

A further object of the present invention is the provision of an improved spark device which will increase engine efficiency and reduce engine emissions.

A further object of the present invention is the provision of an improved spark device which is efficient in operation, economical to manufacture, and durable in use.

SUMMARY OF THE INVENTION

The spark device of the present invention is capable of delivering a plurality of sparks simultaneously within the combustion chamber. The device can be designed so as to provide the sparks in any particular configuration desired so as to maximize the efficiency of combustion within the combustion chamber.

The device comprises a plurality of electrical segments which are arranged in a line, and which are spaced apart from one another to create spark gaps therebetween. The segments can be arranged in any desired configuration, such as circular, ovular, or any other shape or pattern. Electrical energy is applied to one end of the line of segments, and the other end of the line of segments is connected to ground. The application of electrical energy to the first end of the line of segments will cause sparks to be emitted at each spark gap between the various segments. So long as the sum of the distances between each of the various spark gaps is less than the nearest ground point, the current will pass from one segment to another and provide a spark at each gap.

The multiple point spark device of the present invention may be constructed like a conventional spark plug and screwed into the cylinder block in conventional fashion. It also can be designed in a ring so as to be made part of the head gasket assembly of the engine.

The present device has several advantages. All the sparks are simultaneously activated which is an advantage over other types of multi-spark devices. There is no side electrode interference with the gas explosion, and more than one point of ignition is provided within the combustion chamber. The segments of the device can be arranged in any desired pattern to maximize the combustion within the chamber. Engine efficiency is improved, and engine emissions are reduced.

DESCRIPTION OF THE PREFERRED EMBODIMENT

Figure 1:
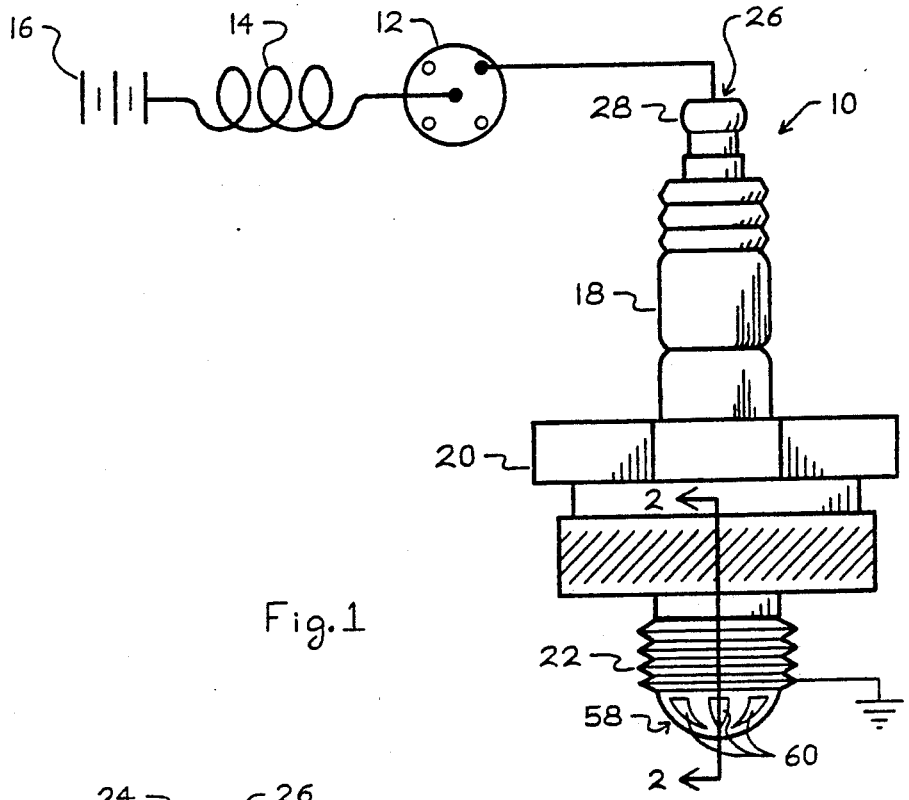
FIG. 1 is an elevational view of the spark plug of the present invention shown schematically connected into an electrical spark inducing circuit.
Figure 2:
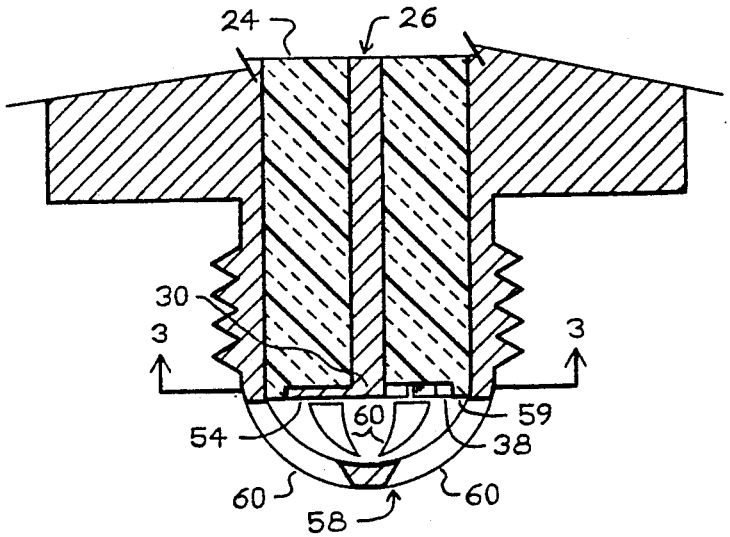
FIG. 2 is a sectional view taken along line 2—2 of FIG. 1.
Figure 3:
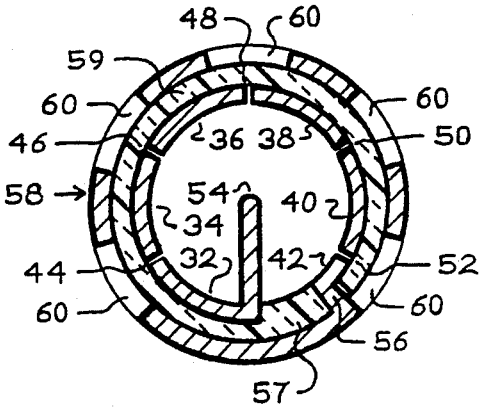
FIG. 3 is a sectional view taken along line 3—3 of FIG. 2.

Referring to the drawings, the numeral 10 generally designates a spark plug constructed in accordance with the present invention. Plug 10 is shown electrically connected to a distributor 12, a coil 14, and an electrical power source 16.

Plug 10 is comprised of a plug body 18 having wrench flats 20 and threads 22 which permit the plug to be threaded into the cylinder block of a combustion engine in conventional fashion.

Within body 12 is a ceramic core 24 having a central electrode 26 extending therethrough. Electrode 26 includes an upper end 28 which protrudes outwardly from body 18 and includes a lower end 30 protruding from the lower end of ceramic core 24.

Arranged on the bottom surface of ceramic core 24 are a plurality of conductive segments 32, 34, 36, 38, 40 and 42. The segments are shown arranged in a circular pattern, bu the pattern can be changed without detracting from the invention. Between the segments are a plurality of spark gaps 44, 46, 48, 50, and 52. Extending from the lower end of 30 of central electrode 26 to the first conductive segment 32 is a connector segment 54 which provides electrical connection therebetween. Extending from electrical conductor segment 42 is a ground connector 56 which is shown in electrical connection with a conductive shield 58 which in turn is connected to ground. Between conductor segment 42 and conductive segment 32 is a dielectric barrier 57 which prevents a spark from being emitted therebetween. Similarly, an annular dielectric barrier 59 surrounds the segment so as to prevent sparks from developing between the segments and the outer housing of shield 58. Shield 58 is in a hemispherical shape and includes a plurality of pie shaped openings 60 which are registered in alignment with the various spark gaps 44, 46, 48, 50 and 52.

It is important that the dielectric barriers 57, 59 prevent sparks from developing between the first segment 32 and the last segment 42 and also between all of the segments and the outer shield 58.

In operation, a charge of electrical energy is introduced from coil 14 and distributor 12 to the upper end 28 of electrode 26. This causes the current to pass sequentially through segments 32, 34, 36, 38, 40, and 42. At each spark gap 44, 46, 48, 50 and 52 a spark develops to permit the current to continue passing through the segments in series. Ground connector 56, because of its connection to the shield, provides a ground connection so that the circuit is complete.

The advantage of this construction is that a plurality of sparks are simultaneous emitted in a circular array within the combustion chamber. This causes the fuel to be ignited more quickly and more evenly throughout the combustion chamber, thereby improving the smoothness and the power of the piston stroke, and also improving the thoroughness with which the fuel is ignited. Unlike prior spark plugs which have electrodes protruding within the combustion chamber, the sparking device of the present invention does not interfere with the expansion of gases within the chamber, thereby improving the smoothness and efficiency of the stroke of the piston in response to the explosion of the gases. The spark gaps of the present invention are very difficult to foul, and if one gap is fouled, the remaining gaps will continue to provide sparks, thereby increasing the useful life of the device.

Figure 4:
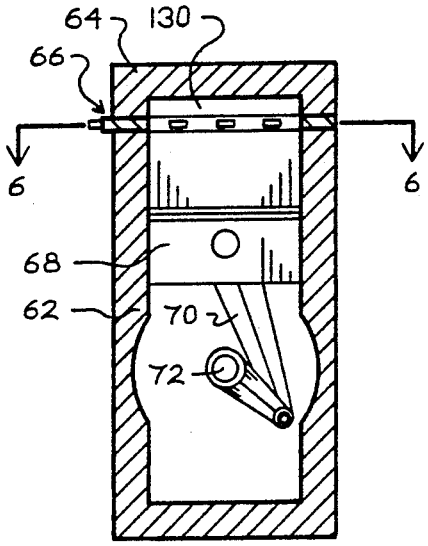
FIG. 4 is a sectional view of a typical combustion cylinder utilizing a second modification of the spark device of the present invention.
Figure 5:
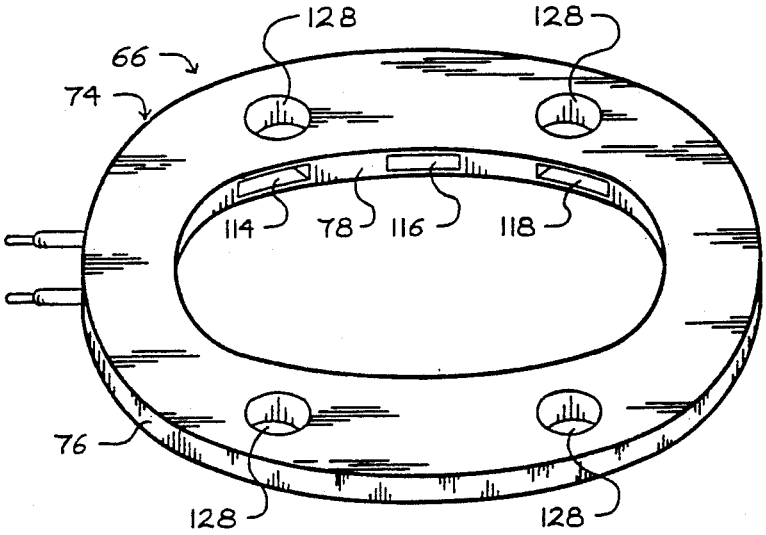
FIG. 5 is an enlarged pictorial view of the modified form of the spark device shown in FIG. 4.
Figure 6:
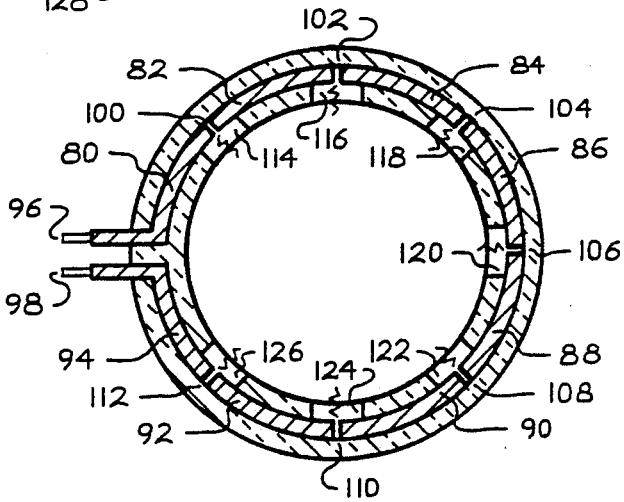
FIG. 6 is a sectional view taken along line 6—6 of FIG. 4.

Referring to FIG. 4, a modified form 66 of the spark device is shown. Spark device 66 is shown mounted within a conventional engine cylinder 62 having a cylinder head 64 attached over the upper end thereof. Within the cylinder is a piston 68 having a piston rod 70 connected to a cam shaft 72.

Spark device 66 includes a circular body 74 which is constructed to ceramic or other electrically insulated material. Body 74 includes an outer annular surface 76 and an inner annular surface 78 which is in communication with the combustion chamber 130 within the upper end of cylinder 62.

Embedded within circular body 74 is a circular array of conductive segments 80, 82, 84, 86, 88, 90, 92 and 94. Segment 80 is connected to a first lead 96, and segment 94 is connected to a second lead 98. All of the segments are separated by a plurality of spark gaps 100, 102, 104, 106, 108, 110, and 112. Body 74 includes a plurality of radial passageways 114, 116, 118, 120, 122, 124, and 126 each of which is in communication with one of the spark gaps, and each of which is also in communication with the combustion chamber 130. Body 74 is also provided with a plurality of bolt holes 128 which permitted to be mounted between the cylinder head 64 and the cylinder 62 as part of the gasket assembly.

In operation, the lead 96 is connected to a source of electrical energy, and the lead 98 is connected to ground. Introduction of electrical energy causes sparks to be emitted at the various spark gaps, and the spark is communicated into the combustion chamber through the passageways 114, 116, 118, 120, 122, 124, and 126.

As can be seen in the drawings, this device does not intrude or interfere in any way with the exploding gases that are within the combustion chamber, thereby permitting a smooth and powerful force to be applied to the piston during the power stroke of the engine. The large number of sparks in the circular array causes the gas to be more quickly ignited, thereby improving the quickness of the power portion of the engine cycle and improving the strength and efficiency of the power resulting from explosion of the gases within the combustion chamber 130. Thus it can be seen that the device accomplishes at least all of its stated objectives.

We claim:

1. In combination:

an internal combustion engine having at least one cylinder having an upper and a lower end, a piston mounted within said cylinder for reciprocating motion therein, and a combustion chamber located within said cylinder between said upper end of said cylinder and said piston, said cylinder having cylindrical walls which define sidewalls for said combustion chamber;

a spark device for causing a plurality of sparks in said combustion chamber, said spark device comprising a plurality of electrically conductive segments within said combustion chamber and arranged in a line forming a predetermined pattern within said combustion chamber, said line of segments having a first segment at one end of said line and a second segment at the opposite end of said line;

said segments being spaced apart form one another within said line so as to create a plurality of spark gaps therebetween;

first lead means connected to said first segment and adapted to be connected to a source of electrical energy;

second lead means connected to said last segment and adapted to be connected to ground, whereby the introduction of electrical energy to said first lead means causes sparks to be emitted at all of said spark gaps;

a cylinder head secured in covering relation over said upper end of said cylinder;

an annular ring body made of electrically insulative material secured between said cylinder head and said upper end of said cylinder and having an inner circular surface facing radially inwardly towards, and being exposed to, said combustion chamber, said plurality of segments being contained within said ring body;

said ring body having a plurality of radial passageways each extending radially outwardly from said inner circular surface of said ring body to one of said spark gaps so as to provide communication from said spark gaps to said combustion chamber.

2. A spark device for causing a plurality of sparks in the combustion chamber of an internal combustion engine, said device comprising:

an insulative body;

a plurality of electrically conductive segments connected to said insulative body and arranged in a line forming a predetermined pattern, each of said segments being spaced a predetermined distance from one another so as to create a plurality of spark gaps between said segments, said line of segments having a first segment at one end of said line and a last segment at the opposite end of said line;

first lead means connected to said first segment and adapted to be connected to a source of electrical energy;

second lead means connected to said last segment and adapted to be connected to ground, whereby the introduction of electrical energy to said first lead means causes sparks to be emitted at all of said spark gaps;

an insulative barrier being positioned between said first segment and said last segment for preventing a spark from being emitted directly between said first and last segment.

3. A spark device according to claim 2 wherein said insulative body is adapted to be mounted to said internal combustion engine in such a manner that said spark gaps ar located within said combustion chamber of said engine.

4. A spark plug comprising:

an elongated plug body having an upper end and a lower end;

an elongated electrode extending through said body and having an upper end protruding above said upper end of said plug body and a lower end adjacent said lower end of said plug body;

a spark device adjacent said lower end of said electrode, said spark device comprising a plurality of electrically conductive segments arranged in an arcuate pattern, each of said segments being spaced apart from one another to form spark gaps therebetween;

first connection means connecting said lower end of said electrode to one of said segments;

second connection means connecting another one of said segments to ground, so that said arcuate pattern of said segments provides a series connection between said lower end of said electrode and ground, whereby the introduction of electrical current to said upper end of said electrode will cause a spark to be emitted at each one of said spark gaps;

an insulative barrier being positioned between said one segment, and said other segment for preventing a spark from being emitted directly between said one segment and said other segment.

5. A spark plug according to claim 4 wherein said arcuate pattern is circular in shape.

6. A spark plug according to claim 4 wherein shield means are in covering relationship over said segments, said shield means having a plurality of openings, each of which is positioned in registered alignment with one of said gaps.

7. A spark plug according to claim 4 wherein each of said segments of said spark device is elongated and has opposite ends, said segments being arranged in end to end relationship with said spark gaps being between adjacent ends of said segments.

8. A spark plug according to claim 7 wherein said segments of said spark device are in substantially the same plane.

9. In combination:

an internal combustion engine having at least one cylinder having an upper end and a lower end, a piston mounted within said cylinder for reciprocating motion therein, and a combustion chamber located within said cylinder between said upper end of said cylinder and said piston, said cylinder having cylindrical walls which define sidewalls for said combustion chamber;

a spark device for causing a plurality of sparks in said combustion chamber, said spark device comprising a plurality of electrically conductive segments within said combustion chamber and arranged in a line forming a predetermined pattern within said combustion chamber, said line of segments having a first segment at one end of said line and a second segment at the opposite end of said line;

said segments being spaced apart form one another within said line so as to create a plurality of spark gaps therebetween;

first lead means connected to said first segment and adapted to be connected to a source of electrical energy;

second lead means connected to said last segment and adapted to be connected to ground, whereby the introduction of electrical energy to said first lead means causes sparks to be emitted at all of said spark gaps;

an insulative barrier being positioned between said first segment and said last segment for preventing a spark from being emitted directly between said first and last segments.

10. A combination according to claim 9 comprising an elongated plug body operatively connected to said cylinder and having a lower end in communication with said combustion chamber, said spark device being mounted on said lower end, elongated electrode means within said plug body having an external end protruding from said plug body externally of said combustion chamber and an internal end electrically connected to said first lead means.

11. A combination according to claim 9 comprising a cylinder head secured in covering relation over said upper end of said cylinder, an annular ring body made of electrically insulative material secured between said cylinder head and said upper end of said cylinder and having an inner circular surface exposed to said combustion chamber, said plurality of segments being contained within said ring body, a plurality of radial passageways in said ring body each extending from said combustion chamber to one of said spark gaps so as to provide communication from said spark gaps to said combustion chamber.

12. A combination according to claim 9 wherein said predetermined pattern of said line of segments comprise a circle.

13. A combination according to claim 12 wherein said circle extends around said sidewalls of said combustion chamber.

* * * * *